US009498104B2

(12) United States Patent
Ben-Haim

(10) Patent No.: US 9,498,104 B2
(45) Date of Patent: Nov. 22, 2016

(54) DISHWASHER RACK ASSEMBLY HAVING POSITIONABLE SUPPORT MEMBERS

(71) Applicant: Niv Ben-Haim, Richmond Hill, CA (US)

(72) Inventor: Niv Ben-Haim, Richmond Hill, CA (US)

( * ) Notice: Subject to any disclaimer, the term of this patent is extended or adjusted under 35 U.S.C. 154(b) by 0 days.

(21) Appl. No.: 14/962,138

(22) Filed: Dec. 8, 2015

(65) Prior Publication Data

US 2016/0128544 A1 May 12, 2016

Related U.S. Application Data

(63) Continuation-in-part of application No. 14/535,540, filed on Nov. 7, 2014, now abandoned.

(51) Int. Cl.
*A47L 15/50* (2006.01)

(52) U.S. Cl.
CPC ..... *A47L 15/505* (2013.01)

(58) Field of Classification Search
CPC . A47L 15/504; A47L 15/505; A47L 15/501; A47L 19/04; A47L 15/503; A47L 15/50; A47F 7/0064; A47F 5/01; A47J 47/16; A47B 81/04
USPC ..... 211/41.9
See application file for complete search history.

(56) References Cited

U.S. PATENT DOCUMENTS

| | | | | |
|---|---|---|---|---|
| 2,708,037 | A | 5/1955 | Planeta | |
| 3,063,567 | A | 11/1962 | Campbell | |
| 3,221,677 | A | 12/1965 | Kerr | |
| 3,752,324 | A | 8/1973 | Moser | |
| 4,023,682 | A | 5/1977 | Niece | |
| 4,046,261 | A | 9/1977 | Yake | |
| 4,178,844 | A | 12/1979 | Ward et al. | |
| 4,437,572 | A | 3/1984 | Hoffman | |
| 4,589,556 | A | 5/1986 | Peretz | |
| 1,606,464 | A | 8/1986 | Jordan et al. | |
| 4,917,248 | A | 4/1990 | Friskney | |
| 5,520,118 | A | 5/1996 | McCarthy | |
| D371,027 | S | 6/1996 | Skurman | |
| 5,918,749 | A | 7/1999 | Pille et al. | |
| 6,460,710 | B1 * | 10/2002 | Dardashti | A47B 57/26 108/61 |
| 6,827,225 | B2 | 12/2004 | Miilu et al. | |
| 6,976,596 | B2 | 12/2005 | Brooks | |
| 7,543,712 | B2 | 6/2009 | Purushothaman | |
| 7,682,465 | B2 | 3/2010 | Anderson et al. | |
| 7,793,790 | B2 | 9/2010 | Lee | |
| 8,104,628 | B2 | 1/2012 | Kim | |
| 8,408,403 | B2 | 4/2013 | Hedstrom et al. | |
| 8,540,085 | B2 | 9/2013 | Klump et al. | |
| 8,579,121 | B2 | 11/2013 | Eng et al. | |
| 8,646,620 | B2 | 2/2014 | Klump et al. | |
| 9,050,848 | B2 | 6/2015 | Tsai | |
| 2012/0306333 | A1 * | 12/2012 | Eng | A47L 15/505 312/228.1 |

* cited by examiner

*Primary Examiner* — Korie H Chan
(74) *Attorney, Agent, or Firm* — Shalom Wertsberger; Saltamar Innovations

(57) ABSTRACT

A dishwasher rack assembly including a bottom wall formed of a first set of wire rods in parallel, uniform spaced relation to each other perpendicular a second set of wire rods in parallel, uniform spaced relation to each other, the first and second sets of wire members defining open, square lattice areas. One or more support members are coupled intermediate opposing wire rods of the first or second set within a selected lattice area. Each support member comprises an upwardly directed, support frame for optimally positioning the objects to be washed, the opposed ends thereof extending into mounting receivers that are adapted to be positionally coupled between opposed wire rods of the bottom wall of the dishwasher rack.

6 Claims, 8 Drawing Sheets

DISHWASHER RACK ASSEMBLY HAVING POSITIONABLE SUPPORT MEMBERS

REFERENCE TO RELATED APPLICATIONS

This application is a continuation in part of U.S. patent application Ser. No. 14/535,540 filed Nov. 7, 2014, said Patent Application is incorporated herein by reference in its entirety.

BACKGROUND

The present invention generally relates to dishwasher racks and more particularly to those that employ positionable support members for the articles to be washed.

Conventional dishwashers include one or more racks to support items to be washed such as dishware, glassware, kitchen utensils, pots, pans and the like. Typically, dishwashers employ an upper and a lower rack. A conventional dishwasher rack includes a bottom wall formed of spaced apart transverse rods crossed by spaced apart longitudinal rods to define an open lattice structure. A plurality of fixed vertical tines extend upwardly from the bottom wall and are arranged in pairs along the longitudinal or transverse rods of the bottom wall with a defined space between adjacent pairs of the fixed vertical tines. Since the articles to be washed vary in size, thickness and weight, the use of fixed equally spaced supporting tines is inefficient and is less than optimal for possible combinations of items to be washed. The present invention resolves these problems by providing a dishwasher rack with positionable support members and thereby allow the user to determine the configuration of the supporting members to adapt to the articles to be washed.

The prior art discloses a variety of structures intended to resolve the problem inherent in dishwasher racks that employ a fixed set of equally spaced tines to support the objects to be washed. U.S. Pat. No. 4,917,248 employs a folding fence on which equally spaced tines are mounted that is moveable between a folded position adjacent the bottom of the rack and an erect or operating position. U.S. Pat. No. 8,540,085 discloses the use of a U-shaped frame structure from which upwardly depending tines are amounted and where the frame structure can be removably coupled to the bottom lattice structure of a dishwasher rack. The prior art fails to resolve the problem that arises when the articles to be washed differ in size and shape.

The present invention dishwasher rack assembly resolves the problems inherent in the prior art by providing a dishwasher rack assembly that includes positionable support members that can be selectively coupled to the bottom wall of the dishwasher rack in a manner that simplifies and enhances the user=s ability to configure the structure of the dishwasher rack assembly to the size and shape of the articles to be washed.

SUMMARY

The present invention comprises a dishwasher rack assembly that includes a dishwasher rack and positionable support members to support the objects to be washed. The dishwasher rack has substantially upstanding front, rear and side walls and a generally horizontally disposed bottom wall formed of a plurality of uniformly spaced longitudinal and transverse rods. The longitudinal and transverse rods are substantially perpendicular to each other. The intersection of the longitudinal and transverse rods define square lattice areas bounded by opposed portions of the longitudinal and transverse rods. The positionable support members comprise a resilient support frame having a pair of support legs extending downwardly from the opposed ends of a horizontally positioned bracing member. Mounting receivers are secured to the ends of each of the support legs opposite the bracing member and are adapted to engage opposed portions of the transverse or longitudinal members within a square lattice structure of the bottom wall of the dishwasher rack. A support member may be repositioned within any square lattice area of the bottom wall by imposing inwardly directed forces on the ends of the support legs thereby disengaging the mounting receivers and moving the support member to a different square lattice area where the mounting receivers can be engaged upon the release of the inwardly directed force on the support arms.

It is therefore an object of the present invention to provide an improved dishwasher assembly that provides for positionable support members.

It is another object of the present invention to provide support members for a dishwasher assembly that can be selectively engaged to longitudinal or transverse wire members of the bottom wall of the dishwasher rack.

It is yet another object of the present invention to provide a dishwasher assembly that can be adapted to the size and shape of the objects that are to be washed.

It is still yet another object of the present invention to provide a dishwasher rack assembly that is simple and inexpensive to fabricate.

The novel features which are believed to be characteristic of the invention, both as to its organization and method of operation, together with further objectives and advantages thereof, will be better understood from the following description considered in connection with the accompanying drawing in which a presently preferred embodiment of the invention is illustrated by way of example. It is to be expressly understood, however, that the drawing is for the purpose of illustration and description only, and is not intended as a definition of the limits of the invention.

DETAILED DESCRIPTION

Figure 1:
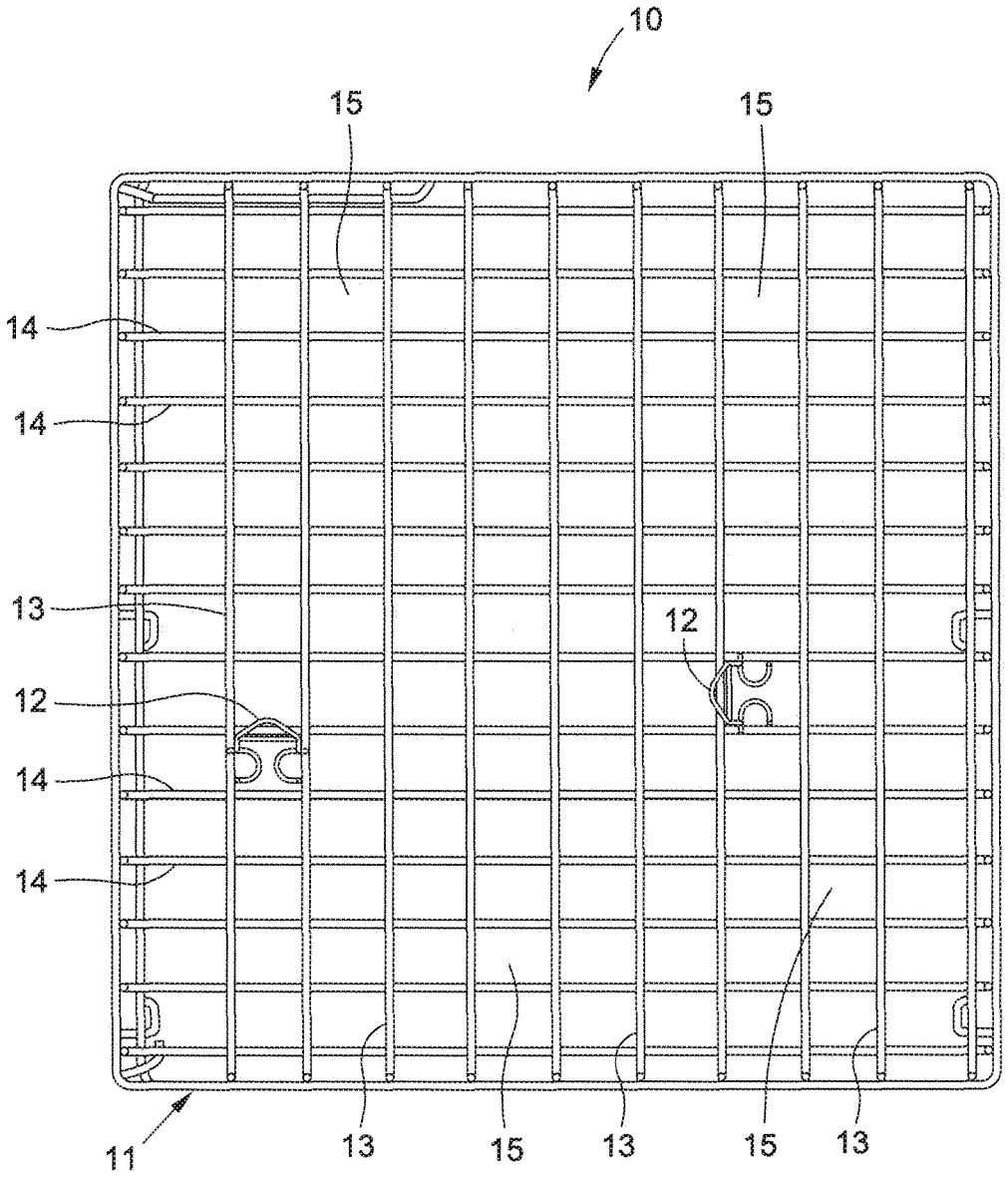
FIG. 1 is a top plan view of a dishwasher rack with two support members of an embodiment of the present invention mounted within lattice structures.

Reference will now be made in detail to embodiments of the present invention, examples of which are illustrated in the accompanying drawings. Each example is provided by way of explanation of the invention, and not as a limiting illustration of the invention. It will be apparent to those skilled in the art that various modifications and variations can be made in the present invention without departing from the scope or spirit of the invention. As an example, the features that are described and illustrated in the drawing as part of one embodiment may be used with other embodiments of the invention to yield a still further embodiment. Therefore, it is intended that the present invention cover all modifications and variations that fall within the scope of the claims and their equivalents.

Spatially relative terms, such as "inner," "outer," "beneath," "below," "lower," "above," "upper," and the like, may be used herein for ease of description to describe one element or feature's relationship to another element(s) or feature(s) relative to a specified orientation of an embodiment or a portion thereof. Spatially relative terms may be intended to encompass different orientations of the device in use or operation in addition to the orientation depicted in the figures. For example, if a first element is described as being "beneath" other elements or features than the other elements or features would be "above" the first element in the described orientation, but if the device is otherwise oriented the spatially relative descriptors used herein should be interpreted with respect to such orientation. In these specifications the term "vertical" relates to an axis extending orthogonally from the longitudinal and transverse rods defining the bottom wall of the dishwasher rack disclosed herein, and the 'up' direction associated therewith extends to the side of the bottom wall the direction at which items to be washed would be placed during normal use. Axis, planes, and directions in a support member are defined relative to an orientation where the support member is engaged between the longitudinal and transverse rods of the bottom wall of the dishwasher rack, by the mounting receivers, and are defined for convenience and brevity of description, not as geometrical or symmetrical axis or planes of the support member geometry. The longitudinal axis of a support member extends vertically from the middle of a line extending between the support arms generally at the level of the adjacent transverse or lateral rods while the support member is engaged therewith as described supra. The longitudinal plane of a support member is defined by the longitudinal axis of the support member and the line extending between the support arms at the level of the bottom wall of the dishwasher rack. The longitudinal out direction extends orthogonally away from both sides of the vertical axis. The lateral plane of the support member is generally defined by the transverse and/or longitudinal rods adjacent to the support member, and coupled to the mounting receivers.

The present invention comprises a dishwasher rack assembly that can be adapted by the user to provide an optimal configuration that is dependent upon the size and shape of the objects to be washed. FIG. 1 generally illustrates a preferred embodiment of the present invention dishwasher rack assembly designated by the reference numeral 10. The present embodiment comprises a dishwasher rack 11 and a plurality of positionable support members 12 that are employed to optimally position the objects that are to be washed. Dishwasher rack 11 includes a bottom wall comprising a plurality of longitudinal rods, such as by way of example wire rods 13 in substantially uniform, parallel spaced relation to each other and a plurality of transverse rods, such as by way of example wire rods 14 in uniform, parallel spaced relation to each other. The transverse rods 14 are oriented at right angles to longitudinal rods 13. The intersection of adjacent longitudinal rods 13 and transverse rods 14 create substantially equally sized, square lattice areas 15 throughout the bottom wall of dishwasher rack 11 within which the positionable support members 12 may be mounted. Each lattice area 15 is formed by opposed sections of adjacent longitudinal wire rods 13 and opposed sections of adjacent transverse wire rods 14.

The structure and function of an embodiment of support members 12 can be best understood by reference to FIGS. 2-6, inclusive. A support member 12 includes a support frame 20 comprising support arms 21 and 22 extending downwardly and outwardly from engagement flange 32. In some embodiments the support frame is planar. While in the depicted embodiment engagement flange 32 is intersected by the vertical axis, it may be offset in other embodiments. Support frame 20 is constructed of resilient material that may be deflected by the imposition of force but will return to its original configuration when the force is removed. Support arms 21 and 22 depend outwardly and downwardly from engagement flange 32 and in the depicted embodiment are secured to opposing ends of an optional bracing member 25. Lower leg 23 extends substantially vertically downward from the interface between bracing member 25 and support arm 21, the lower end of support leg 23 being secured to mounting receiver 26. In a like manner, lower support leg 24 extends substantially vertically downward from the intersection between bracing member 25 and support arm 22, the end thereof in opposition to bracing member 25 being secured to mounting receiver 27. In the depicted embodiment lower legs 23 and 24 are perpendicular to the surface of mounting receivers 26 and 27, respectively, and are in parallel spaced relation to each other. Although the preferred embodiment of the present invention employs a support frame 20 that is in a planar configuration, it will be understood by persons having skill in the art that the support frame 20 may comprise upper support sections 21 and 22 that are angularly offset from lower support legs 23 and 24.

Figure 2:
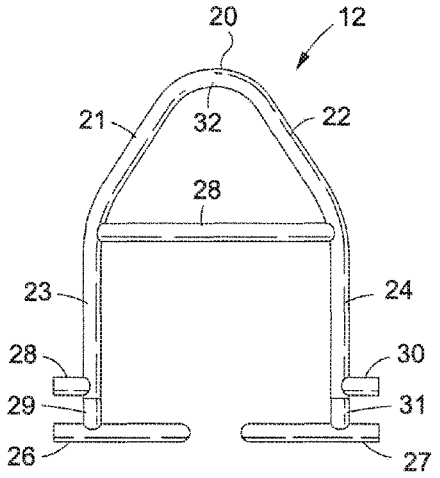
FIG. 2 is a front elevation view of a support member in accordance with an aspect of the present invention.
Figure 3:
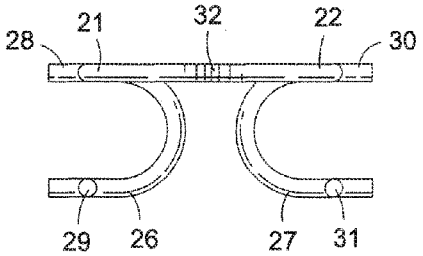
FIG. 3 is a top plan view of the support member of FIG. 2.
Figure 4:
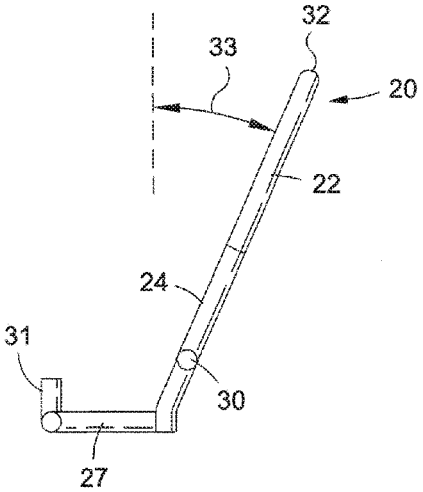
FIG. 4 is a right side elevation view of the support member of FIG. 2.

In order to mount securing members 12 within a lattice area 15, planar mounting receivers 26 and 27 are secured to the bottom of lower support legs 23 and 24, respectively, and are in perpendicular relationships thereto. Generally each mounting receiver has a rod engaging end extending outwardly from their respective leg, to engage the longitudinal 13 or lateral 14 rods of the dishwasher rack. Several embodiments of mounting receivers and engaging ends are disclosed hereinbelow. Referring to the embodiment depicted in FIGS. 2 and 5, mounting receiver 26 is a U-shaped flange extending laterally beyond lower support leg 23 to an extent substantially equal, or greater than the diameter of longitudinal rods 13 or transverse wire rods 14. Vertical limiting pin 28 is in parallel spaced relation to mounting receiver 26, the distance between vertical limiting pin 28 and mounting receiver 26 being substantially equal, or larger than, the diameter of longitudinal and transverse wire rods 13 and 14 respectively. Horizontal limiting pin 29 extends upwardly from mounting receiver 26 in alignment with the interface between lower supporting leg 23 and mounting receiver 26. As shown in FIGS. 2 and 4, mounting receiver 27 is a U-shaped flange extending laterally beyond lower support leg 24 to an extent substantially equal or larger than the diameter of longitudinal rods 13 or transverse rods 14. Vertical limiting pin 30 is in parallel, spaced relation to mounting receiver 26, the distance between vertical limiting pin 30 and mounting receiver 27 being substantially equal or larger than the diameter of longitudinal and transverse wire rods 13 and 14. Horizontal limiting pin 31 extends upwardly from mounting receiver 27 in alignment with the interface between lower supporting leg 24 and mounting receiver 27. To maintain the stability of a support member 12 when engaged with the bottom wall of dishwasher rack 11, the plane of support frame 20 is angularly deflected from a vertical position as shown by reference numeral 33. As will be explained in detail hereinbelow, by deflecting the support frame in the manner shown in FIGS. 4 and 5, the stability of the support frame 20 is maintained by the weight of an object engaged with or adjacent to a support frame 20. Although the preferred embodiment of the present invention employs a support frame 20 that is angularly deflected from a vertical position, it would be understood by those having skill in the art that the objectives of the present invention will also be achieved by support frame 20 that are substantially vertical.

Figure 5:
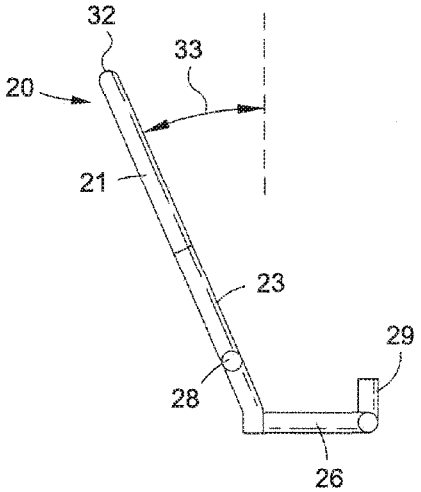
FIG. 5 is a left side elevation view of the support member of FIG. 2.
Figure 6:
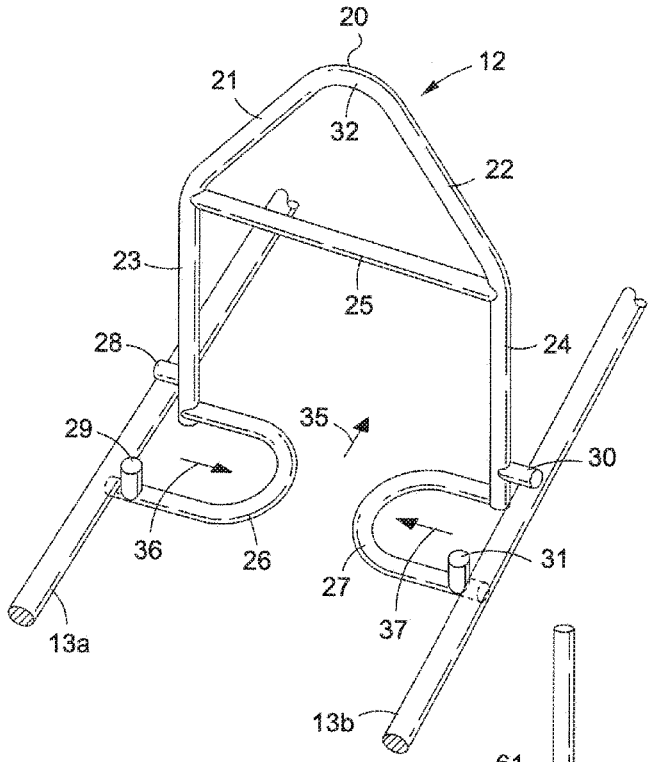
FIG. 6 is an enlarged perspective view of a support member mounted to the bottom wall of the dishwasher rack in accordance with an aspect of the present invention.

FIG. 1 illustrates two support members 12 engaged within lattice areas 15 of the bottom wall of dishwasher rack 11. The procedure by which a support member 12 may be mounted within a lattice area 15 can best be understood by reference to FIG. 6. FIG. 6 illustrates a support member 12 engaged by the respective engaging ends of the mounting receivers between opposed longitudinal wire rods 13*a* and 13*b*. In the engaged position, wire rod 13*a* is positioned upon mounting receiver 26 adjacent horizontal limiting pin 29 and beneath vertical limiting pin 28. In a like manner, longitudinal wire rod 13*b* is positioned upon mounting receiver 27 adjacent horizontal limiting pin 31 and beneath vertical limiting pin 30. As shown in FIGS. 4 and 5, support frame 20 is angularly deflected from a vertical orientation in the manner represented by reference numeral 33. As a result, if an object to be washed is positioned against support frame 20 as represented by reference numeral 35 or is placed upon engagement flange 32, the weight of the object will maintain the contact between horizontal limiting pins 28 and 30 with wire rods 13*a* and 13*b*, respectively, and thereby insure the stability of the mounted support members 12.

To reposition support member 12, mounting receivers 26 and 27 may be disengaged from wire rods 13*a* and 13*b* by applying an inwardly directed force on both mounting receivers in the directions identified by reference numerals 36 and 37. The application of inwardly directed forces 36 and 37 will cause lower support legs 23 and 24 to pivot about their interfaces with bracing member 25 thereby disengaging mounting receivers 26 and 27 in a manner that will permit its removal from the previously selected lattice area 15. The support member 12 may be re-engaged by imposing inwardly directed forces 36 and 37 thereby compressing the support legs 23 and 24 to permit insertion of the support member 12 between opposed wire rods 13 or 14 of a selected lattice area 15. Removal of the inwardly directed forces 36 and 37 will allow the distance between support legs 23 and 24 to expand until mounting receivers 26 and 27 are in engagement with wire rods 13 or 14.

Figure 7:
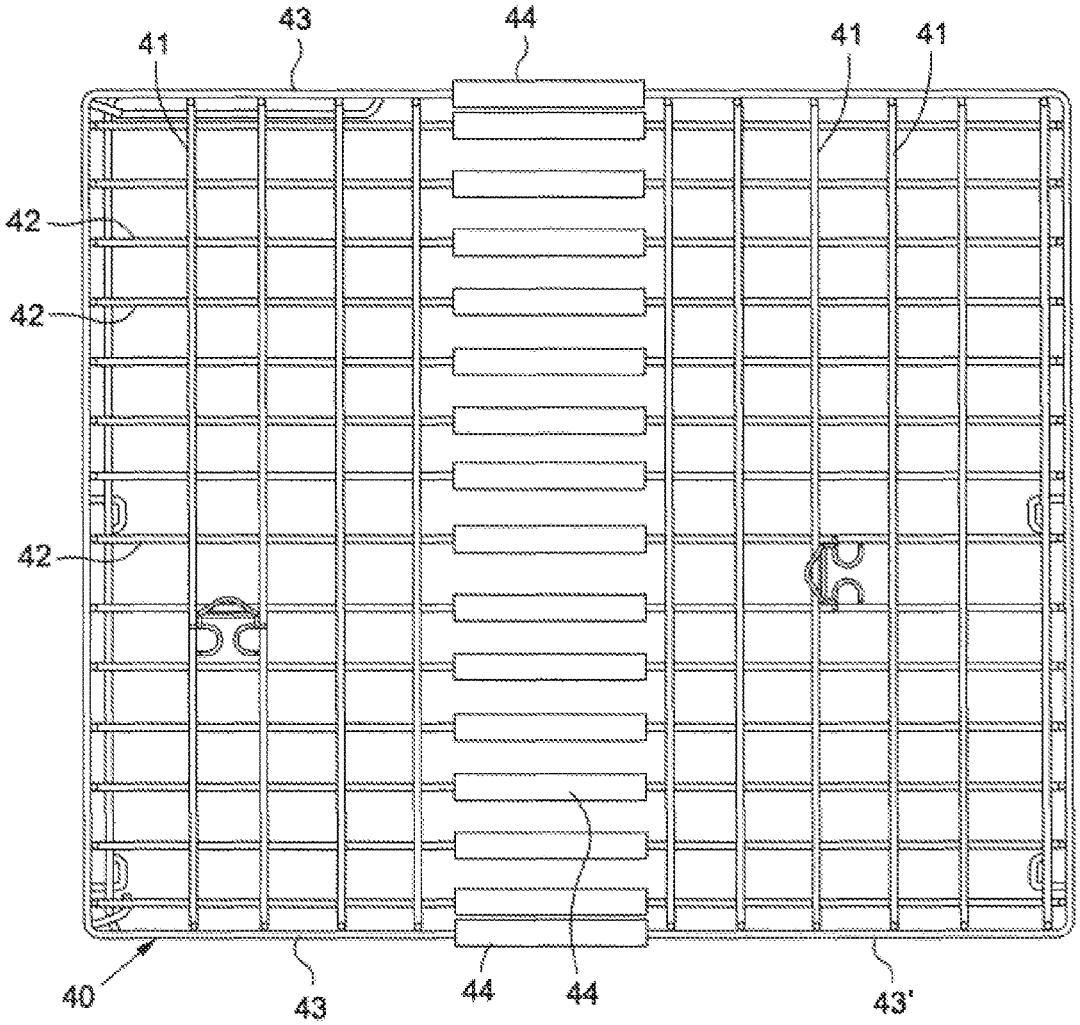
FIG. 7 is a top plan view of the dishwasher rack showing an alternative embodiment of a dishwasher rack in accordance with an aspect of the present invention.
Figure 8:
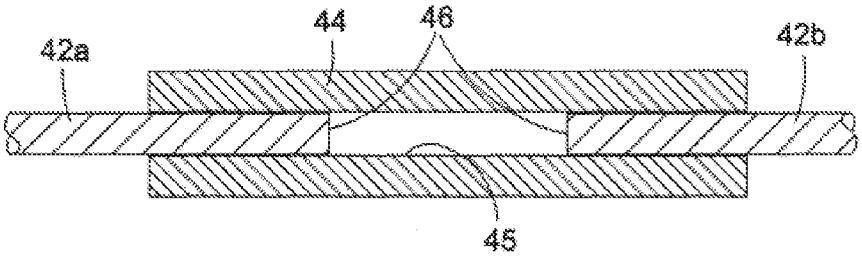
FIG. 8 is an axial cross-sectional view of the rack extension couplings shown in FIG. 7 of the drawing.

Another aspect of the present invention is shown in FIG. 7. FIG. 7 comprises a dishwasher rack that can be employed in dishwashers requiring racks of different sizes, the dishwasher rack being generally designated by the reference numeral 40. Like the dishwasher rack 11 shown in FIG. 1, dishwasher rack 40 includes a bottom wall comprising a plurality of longitudinal rods 41 in spaced relation to each other and a plurality of transverse rods 42. The intersection of adjacent longitudinal rods 41 and transverse rods 42 create a plurality of equally sized square lattice areas 15 throughout the bottom wall of dishwasher rack 40 in a similar manner to that described with respect to dishwasher rack 11. In the embodiment of the present invention shown in FIG. 7, all longitudinal rods 42 in the bottom wall of dishwasher rack 40 as well as the longitudinal rods 43 of the side walls of dishwasher rack 40 are coupled together through the use of extension members 44. FIG. 8 is a cross-sectional view of an extension member 44 used with transverse rod 42. In this embodiment of the present invention, all transverse rods 42 comprise sections 42*a* and 42*b*. Extension member 44 comprises a cylindrical tube, preferably of resilient material, having an axial diameter 45 that can be securely coupled about the circumference of rod segments 42*a* and 42*b*. The width of dishwasher rack 40 can thereby be adjusted as one half 43 of the rack 40 may be movable relative to the other half 43' such that the distance between transverse rods 42*a* and 42*b* varies as long as they are supported to the extension member 44.

Figure 9:
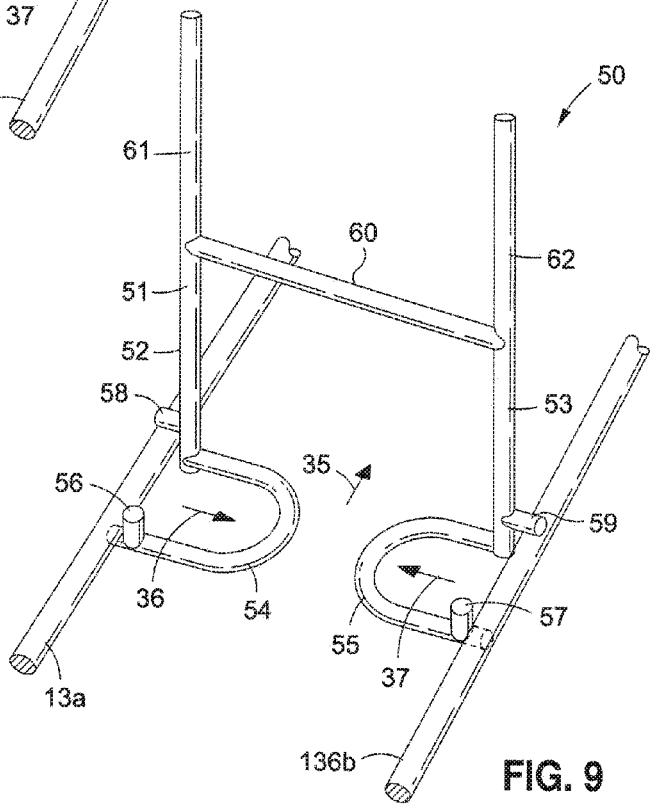
FIG. 9 is an enlarged perspective view of an alternative embodiment of a support member.

As stated hereinabove, it is an objective of the present invention to provide a dishwasher rack assembly that can be optimally configured to respond to the specific objects to be washed. An alternative embodiment of a support member is shown in FIG. 9 and is generally identified by the reference numeral 50. Support member 50 employs a planar support frame 51 comprising lower support legs 52 and 53 that are in parallel spaced relation to each other. Lower support legs 52 and 53 are coupled to mounting receivers 54 and 55, respectively, in the manner shown in FIGS. 4 and 5 by way of example. As described with respect to mounting receivers 26 and 27, horizontal limiting pin 56 extends upwardly from the top surface of mounting receiver 54 and horizontal limiting pin 57 extends upwardly from the upper surface of mounting receiver 55. Vertical positioning is also provided by vertical limiting pin 58 and it is secured to support leg 52 in parallel, spaced relation to the top surface of mounting receiver 54. In a like manner, horizontal limiting pin 59 is secured to support leg 53 in parallel, spaced relation to the top surface of mounting receiver 55. In the manner shown in FIG. 2, in this alternative embodiment, bracing member 60 is secured between support legs 52 and 53 at the upper ends thereof and is in parallel, spaced relation to mounting receivers 54 and 55. Upper support arms 61 and 62 are secured to bracing member 60 in axial alignment with lower support legs 52 and 53, respectively. Upper support arms 61 and 62 provide tines upon which glasses and like objects can be placed. A person skilled in the art to which the invention pertains would understand that the number of upper support arms is one of choice, the use of two as shown in FIG. 9 being only for the purpose of example. Support frame 51 is a planar member that may be deflected from a vertical position in precisely the same manner as is shown in FIGS. 4 and 5. When the object to be washed is placed adjacent upper support arm 61 and/or 62, the weight of the object will maintain the positions of vertical limiting pins 58 and 59 adjacent the surface of wire rods 13*a* and 13*b* and thereby maintain support member 50 in a stable position. As described with respect to the orientation of support frame 20, although the alternative embodiment shown in FIG. 9 is angularly deflected as shown in FIGS. 4 and 5, it would be understood by those having skill in the art that the objectives of the present invention will be achieved with a support frame 51 that is substantially vertical. Notably, similar construction may be applied to other depicted and/or described support members, wherein a horizontal bracing member acts as an engagement flange, having the lower support legs coupled thereto, and having upper arms extending therefrom.

The mounting and/or repositioning of support members 50 is accomplished using similar procedure described with respect to the insertion and repositioning of support members 12. To position or disengage mounting receivers 54 and 55 from wire rods 13*a* and 13*b*, the user applies inwardly directed forces 35 and 36 on both mounting receivers 54 and 55. The application of inwardly directed forces 36 and 37 will cause lower support legs 52 and 53 to pivot about their interfaces with bracing member 60 thereby positioning mounting receivers 54 and 55 in a manner that will permit their insertion or removal from a previously selected lattice area 15 and to be positioned in another.

For brevity, the support member will be described hereinafter a being in an orientation where the support member is coupled to a dishwasher rack by mounting receivers that are engaged with parallel rods of the dishwasher rack, and the support frame extends upwardly therefrom.

Figure 10:
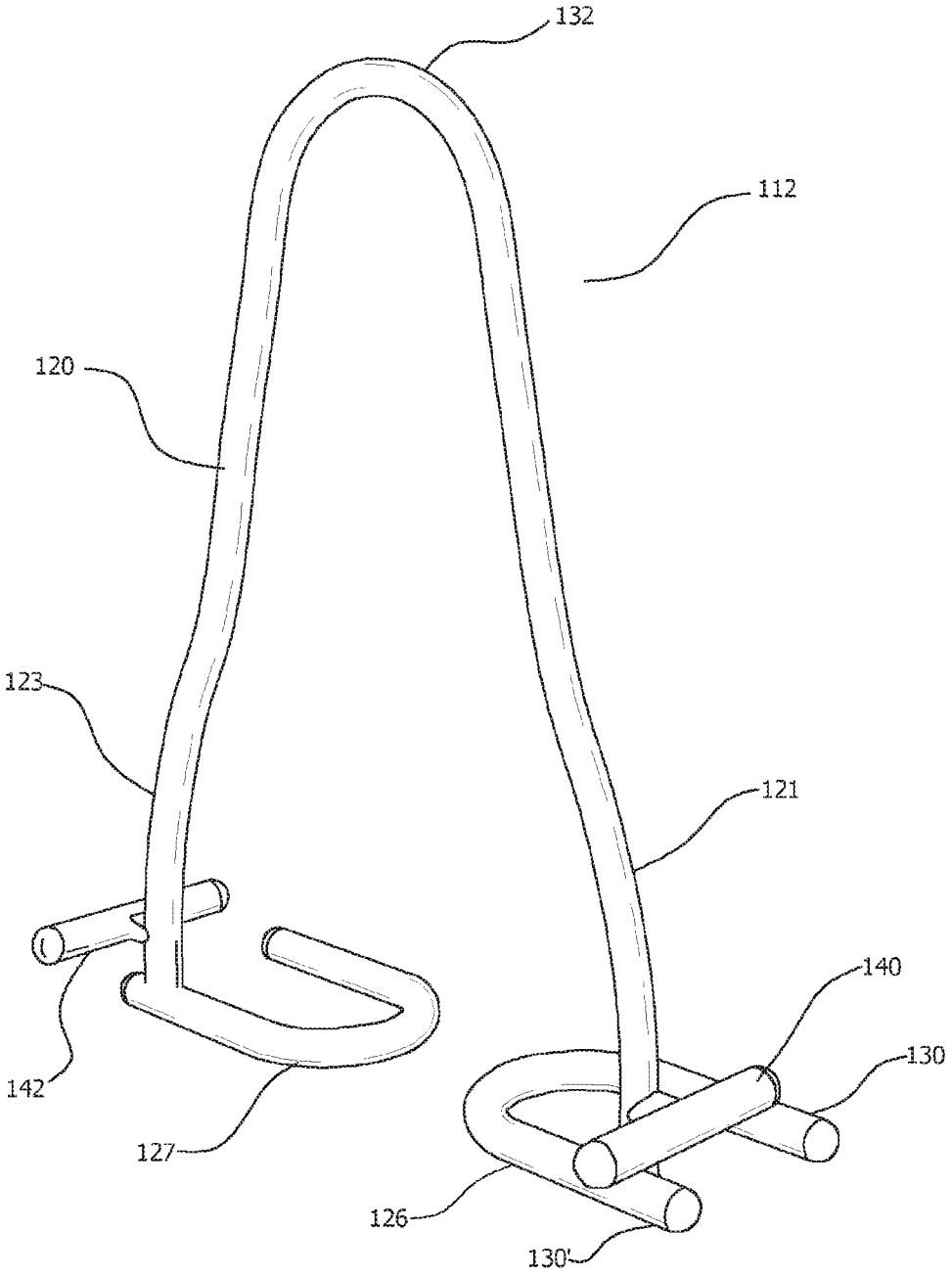
FIGS. 10, 10A, 11, and 12 depict various embodiments of a support member, each having a different mounting receiver.

FIG. 10 depicts yet another embodiment of a support member, generally identified by the numeral 112. Support member 112 includes a support frame 120 comprising support legs 121 and 123 extending downwardly and outwardly from an engagement flange 132. In some embodiments support frame 120 is substantially planar, but the plane may pivot away from the vertical as shown by way of example by angle 33 in FIGS. 4 and 5. Support frame 120 is constructed of resilient material that may be deflected by the imposition of force but will return to its original configuration when the force is removed. Support legs 121 and 123 depend outwardly and downwardly from opposite sides of engagement flange 132. The lower end of support leg 121 being secured to mounting receiver 126. In a like manner, the lower end of support leg 123 being secured to mounting receiver 127. Support legs 121 and 123 extend generally upwardly from mounting receivers 126 and 127, respectively and the support legs are in substantially parallel spaced relation to each other. The skilled in the art will recognize that other securing methods and orientations are readily available.

The mounting receivers 126 and 127 comprise of substantially U-shaped flange extending laterally and inwardly from the lower portion of their respective support legs 121 and 123, each U shaped flange having an apex and a pair of opposing arms extending from the apex, each having an end 130, 130'. The term inwardly imply an orientation of where the apex is disposed towards the support member longitudinal axis. At least one of the ends 130, 130' extends laterally and outwardly to its respective support leg at least to an extent larger that the radius of longitudinal rods 13 and/or transverse rods 14, and such laterally extending end shall be referred as rod-engaging end. Preferably, the ends of both arms of the U-shaped flange extend laterally and outwardly of their respective support leg, and act as rod-engaging ends.

A top securing bar 140 is secured transversely to support leg 121 relative to longitudinal plane, and substantially parallel with the lateral plane of the support member 120. Preferably the top securing bar extends parallel to the lateral plane to a length greater than the diameter of the longitudinal rods 13 and/or transverse rods 14, and when engaged therewith, in parallel relationship thereto. The top securing bar 140 is disposed above the mounting receiver, the distance between the U-shaped flange and the securing bar substantially equal, or greater than, the diameter of the longitudinal rods 13 and/or transverse rods 14. Top securing bar 142 is similarly coupled to support leg 123 in similar relationship thereto and with its respective mounting receiver 127. The top securing bar and at least one of the ends 130 130' of the U-shaped flange form the engaging end of the mounting receiver. The mounting and/or repositioning of support members 110 is accomplished using similar procedure described with respect to the insertion and repositioning of support members 12 and 50. In the engaged state, two longitudinal rods 13 or two transvers rod 14 are engaged by the engaging ends of the respective mounting receivers such that the rods are engaged on their lower side by the bottom supporting ends 130, 130' (if both exist), and the rods are further engaged by the top securing bars on their top side.

Figure 10A:
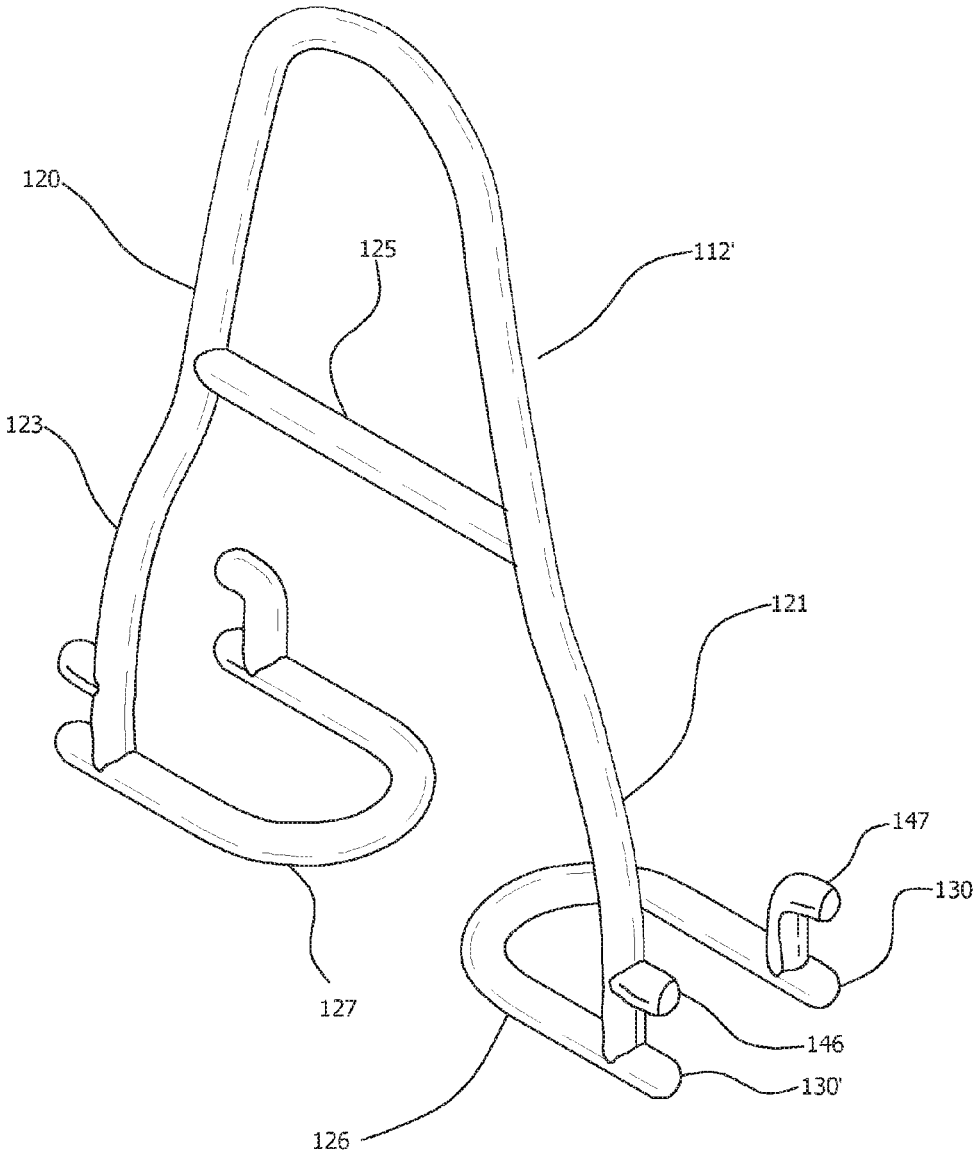
Figure 11:
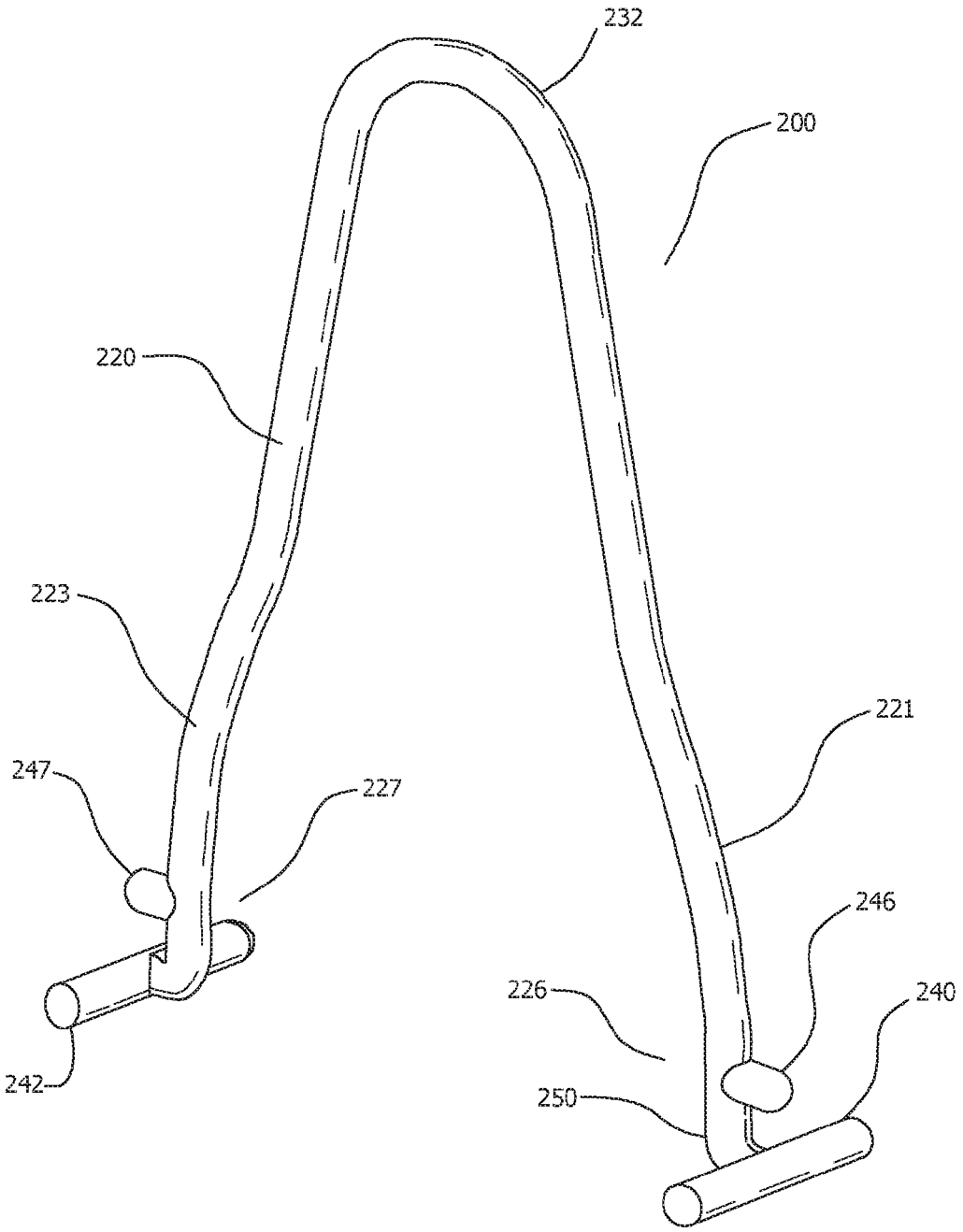

FIG. 10A depicts the support member 120 of FIG. 10, with a few exemplary modifications. Firstly, it is noted that any of the embodiments disclosed herein may optionally utilize a support brace, and thus one example of a bracing member is depicted and denoted in this embodiment as numeral 125. Furthermore, the support member 112' of FIG. 10A utilize a different type of engaging ends of the mounting receivers 126 and 127, where the top securing bar is replaced by two vertical support pins 146 and 147. A first vertical support pin 146 is coupled to the support leg 121 and the second vertical support pin 147 is coupled to the mounting receiver 126 at some horizontal distance from the first vertical support pin 146. The first and second vertical support pins extend horizontally and outwardly from support leg 121, and are disposed at a vertical distance substantially equal to, or greater than, than the diameter of the longitudinal rods 13 and/or transverse rods 14. The section of the support leg may be utilized as a horizontal positioning pin, and in some embodiments the second support pin is coupled to the arm of the U-shaped flange by a horizontal positioning pin extending vertically between the second vertical support pin and the U-shaped flange. However a horizontal positioning pin is desired to limit the extent that the mounting receivers and the support members can move laterally. In the depicted embodiment mounting receiver 127 is constructed similarly to mounting receiver 126, and is secured to support leg 123 in a symmetrically opposite relationship, as shown. Horizontal positioning limits are provided at least by the portion of the support leg lying between the FIG. 11 depicts yet another embodiment of a support member generally identified by the numeral 200. Support member 200 includes a support frame 220 comprising support legs 221 and 223 extending downwardly and outwardly from an engagement flange 232. In some embodiments support frame 220 is substantially planar, but the plane may pivot away from the vertical as shown by way of example by angle 33 in FIGS. 4 and 5. Support frame 200 is constructed of resilient material that may be deflected by the imposition of force but will return to its original configuration when the force is removed. Support legs 221 and 223 depend outwardly and downwardly from opposite sides of engagement flange 232. The lower end of support leg 221 is secured to mounting receiver 226. In a like manner, the lower end of support leg 223 is secured to mounting receiver 227. Support legs 221 and 223 extend generally upwardly from mounting receivers 226 and 227, respectively and the support legs are in substantially parallel spaced relation to each other. The skilled in the art will recognize that other securing methods and orientations are readily available.

The engaging ends of mounting receivers 226 and 227 comprise of a securing bars 240 and 242, respectively. Securing bar 240 is secured to support leg 221 transversely relative to longitudinal plane, and substantially parallel with the lateral plane of the support member 200. Preferably the securing bar 240, 242 extends parallel to the lateral plane to a length greater than the diameter of the longitudinal rods 13 and/or transverse rods 14, and when engaged therewith, in parallel relationship thereto. In some embodiments the bottom securing bar 240, 242 is coupled to the lower extremity of its respective support leg 221, 223, as denoted by way of example by numeral 250

Vertical support pins 246 and 247 are secured to support legs 221, 223, respectively. Vertical support pins 246 and 247 extend horizontally and outwardly from their respective legs 221 and 223, and are disposed at a vertical distance substantially equal to, or greater than, than the diameter of the longitudinal rods 13 and/or transverse rods 14. The mounting and/or repositioning of support members 200 is accomplished using similar procedure described with respect to the insertion and repositioning of support members 12, 50, and 100. In the engaged state, two longitudinal rods 13 or two transvers rod 14 are engaged on their lower side by the bottom securing bars, and the rods are further engaged by the vertical support pins on their top side.

The securing bar in the embodiment depicted in FIG. 11 is shown disposed below the vertical support pin, however, an embodiment where the support pin is below the support bar is also envisioned, but is not shown as its embodiment will be clear to the skilled in the art.

Figure 12:
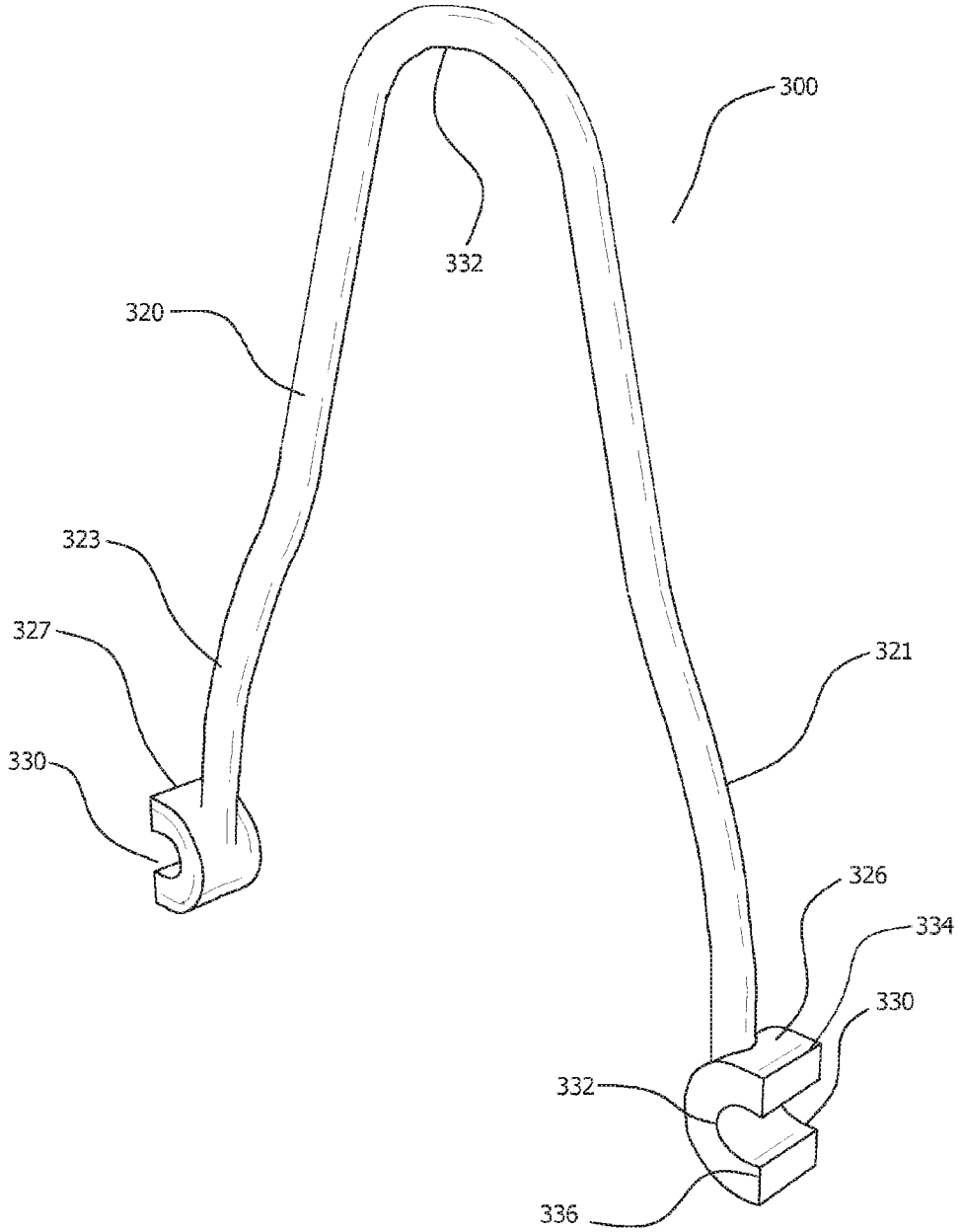

FIG. 12 depicts yet another embodiment of a support member, generally denoted by numeral 300. Support member 300 includes a support frame 320 comprising support legs 321 and 323 extending downwardly and outwardly from an engagement flange 332. In some embodiments support frame 320 is substantially planar, but the plane may pivot away from the vertical as shown by way of example by angle 33 in FIGS. 4 and 5. Support frame 300 is constructed of resilient material that may be deflected by the imposition of force but will return to its original configuration when the force is removed. Support legs 321 and 323 depend outwardly and downwardly from opposite sides of engagement flange 232. The lower end of support leg 321 is secured to mounting receiver 326. In a like manner, the lower end of support leg 323 is secured to mounting receiver 327. Mounting receivers 26 and 327 each have an engaging end. Support legs 321 and 323 extend generally upwardly from mounting receivers 326 and 327, respectively and the support legs are in substantially parallel spaced relation to each other. The skilled in the art will recognize that other securing methods and orientations are readily available.

Mounting receivers comprise securing bars 330 having an outwardly open channel 332, acting as an engaging end. The securing bars of mounting receivers 326 and 327 comprise a channel 332 generally open on its outward side. The structure is described by way of example as relating to mounting receiver 326, and may be replicated on mounting receivers 327, or a different mounting receiver may be utilized. The channel comprises two substantially parallel, outwardly extending channel lips 334 and 336, and coupled at their inward ends by a channel base. The channel may be square, rectangular, of generally C or U cross section, triangular, or of generally open structure. The channel 332 is disposed generally transversely to the longitudinal plane of support member 300, and extends generally parallel to the lateral plane thereof. Preferably the channel 332 extends parallel to the lateral plane to a length greater than the diameter of the longitudinal rods 13 and/or transverse rods 14, and when engaged therewith, in parallel relationship thereto. The channel is dimensioned to engage either a longitudinal rod 13 or a transverse rod 14 and in some embodiments is made of resilient material that engulfs a portion of the rod to an extent greater the rod diameter.

It is noted that at least one aspect the invention extends to the combination of dishwasher rack in combination with any one of the support members described above, while additional aspects of the invention extend to the various embodiments described supra. The dishwasher rack may be expandable or fixed as described above. Furthermore, the skilled in the art would recognize that each support member may, comprise of any combination of mounting receivers, and that in certain embodiments one of the support legs may have a first type of a mounting receiver coupled thereto, while the opposite support leg may utilize a different type of mounting receiver (not shown). Furthermore, additional components, such as by way of example a third and potentially even a fourth, support leg mounted transversely to the longitudinal plane may be utilized (Not shown), with or without a mounting receiver, to provide additional support in a specific direction.

It is noted that all other features and options described above in relation to support members depicted in the figures may be optionally applied to each of the embodiments. Thus, by way of example a bracing members, inclined or vertical support frame, open tines or engaged upper arms, additional vertical and/or horizontal pins, and the like, may be incorporated in the various embodiments, as desired and inclusion or exclusion of such features from various embodiments is a matter of engineering, cost, or aesthetical choice. Furthermore, it is noted that while for clarity and brevity the longitudinal 13 and/or transverse 14 rods of the dishwasher rack were described as having a round cross-section, such rods may be of any cross-section such as by way of example square, rectangular, triangular, ellipsoid, and the skilled in the art would readily understand that terms like width and length, minor and major axis, and the like, would equivalently replace terms like diameter, radius, and the like, which are stated in the specifications and/or the claims, and that minor changes to the structure such as channel shape, pin lengths, and the like, which may be required to accommodate such rod cross-section would be clear to the skilled in the art, and the disclosure and claim extend to such embodiments.

It is noted that various embodiments of the support members depicted as 12, 50, 112, 200, and 300 may be utilized interchangeably with dishwasher rack like the racks identified by numerals 10 or 40, and the like.

Numerous specific details are set forth such as examples of specific components, devices, and methods, to provide a thorough understanding of embodiments of the present invention. It will be apparent to those skilled in the art that specific details need not be employed, that example embodiments may be embodied in many different forms and that neither should be construed to limit the scope of the disclosure. The terminology used herein is for the purpose of describing particular example embodiments only and is not intended to be limiting. As used herein, the singular forms "a," "an," and "the" may be intended to include the plural forms as well, unless the context clearly indicates otherwise. The disclosed embodiments do not preclude additional features, and are intended as illustrative examples, rather than as limiting details. When an element is referred to as being "coupled to" another element, it may be directly on, engaged, connected or coupled to the other element directly or by intervening elements unless the term 'directly coupled' is used, where no intervening elements are present. As used herein, the term "and/or" includes any and all combinations of one or more of the associated listed items.

Although the terms first, second, third, etc. may be used herein to describe various elements, components, regions, layers and/or sections, such designations are only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed above could be equivalently termed a second element, component, region, layer or section without departing from the teachings of the example embodiments.

A dishwasher rack assembly according to the present invention allows the user to adapt the configuration of the dishwasher rack to optimally reflect the various sizes, shapes and weights of the objects to be washed. It will be apparent to those skilled in the art that various modifications and variations can be made in the present invention. Thus, it is intended that the present invention cover the modifications and variations of this invention provided they come within the scope of the appended claims and their equivalent

I claim:

1. A dishwasher rack assembly, comprising:

a dishwasher rack having a bottom wall formed of a plurality of spaced apart lateral rods crossed by longitudinal rods to define substantially open lattice areas, the rack further comprising side walls; and at least one support member adapted to be removably coupled to the bottom wall of the rack within the lattice area, the support member comprising:

a support frame having a first and a second support legs in spaced relation to each other, each having top and bottom ends, the top ends of the first and second support legs being coupled to each other, a first and second mounting receivers coupled to the bottom ends of the first and second support legs respectively, the mounting receivers each having a generally U-shaped flanges having an inwardly directed apex and a pair of positioning arms extending outwardly therefrom, at least one of the positioning arms extending to an outward end which extends outwardly beyond the respective support leg, each mounting receiver further having an engaging end dimensioned to engage at least one of the lateral rods or the longitudinal rods forming the lattice area, and at least the outward end extending beyond the respective support leg being a part of the engaging end;

the support legs being resiliently deflectable towards each other, for selectably engaging and disengaging of the engaging ends with respective bottom wall rods, for coupling and de-coupling of the support member to the rack bottom wall;

the engaging end further comprising a horizontal positioning pin extending upwardly from at least one of the positioning arms disposed at a horizontal distance from the respective support leg, the pin being disposed inwardly from the outward end of the arm; and, a vertical positioning pin secured to the respective support leg, in vertically spaced apart relationship from the outward end of at least one positioning arm, and perpendicular to the horizontal positioning pin.

2. The dishwasher rack as claimed in claim 1, wherein each of the positioning arms extend to a respective outward end which extends outwardly beyond the respective support leg, the engaging end further comprises:

a horizontal positioning pin extending upwardly from at least one of the positioning arms disposed at a horizontal distance from the respective support leg, the pin being disposed inwardly from the outward end of the arm; and, a vertical positioning pin secured to the respective support leg, in vertically spaced apart relationship from the outward ends of the positioning arms, and perpendicular to the horizontal positioning pin.

3. The dishwasher rack as claimed in claim 1, wherein the engaging end further comprises a top securing bar coupled to the respective support leg, and disposed outwardly of the respective support leg and transversely thereto, the top securing bar being disposed in vertically spaced apart relationship to the outward end of at least one of the positioning arms.

4. The dishwasher rack as claimed in claim 1, wherein both of the positioning arms extend to a respective outward end which extends outwardly beyond the respective support leg, the engaging end further comprises a top securing bar coupled to the respective support leg, and disposed outwardly of the respective support leg and transversely thereto, the top securing bar being disposed in vertically spaced apart relationship to the outward ends of the positioning arms.

5. The dishwasher rack as claimed in claim 1, wherein both of the positioning arms extend to a respective outward end which extends outwardly beyond the respective support leg, the engaging end further comprises a first vertical support pin coupled to the respective support leg, and a second vertical support pin coupled to an arm distal from the support leg, the first and second vertical support pins extend horizontally and outwardly at a distance from their respective outward end.

6. The dishwasher rack assembly as claimed in claim 1, wherein the plane of the support frame is angularly deflected from a plane defined by the lateral rods and longitudinal rods.

* * * * *